United States Patent [19]

Koncelik et al.

[11] 4,439,880

[45] Apr. 3, 1984

[54] GERIATRIC BED CONSTRUCTION WITH SIDEGUARDS

[75] Inventors: Joseph A. Koncelik, Worthington; David B. Chaney, Powell, both of Ohio; Walter G. Lockard; Thomas D. Hontz, both of Quakertown, Pa.

[73] Assignee: Burlington Industries, Inc., Greensboro, N.C.

[21] Appl. No.: 188,472

[22] Filed: Sep. 18, 1980

[51] Int. Cl.[3] ..... A47C 21/08

[52] U.S. Cl. ..... 5/429; 5/425

[58] Field of Search ..... 5/425–430, 5/508, 474

[56] References Cited

U.S. PATENT DOCUMENTS

| | | | |
|---|---|---|---|
| 1,371,362 | 3/1921 | Giese | 5/474 |
| 2,093,164 | 9/1937 | DeBoer . | |
| 2,817,856 | 12/1957 | De Witt et al. | 5/430 |
| 2,929,078 | 3/1960 | Smith et al. | 5/428 |
| 3,002,200 | 10/1961 | Murcott | 5/428 |
| 3,125,769 | 3/1964 | Black et al. . | |
| 3,179,957 | 4/1965 | Norton | 5/428 |
| 3,290,701 | 12/1966 | Luff | 5/426 |
| 3,430,274 | 3/1969 | Ikeda | 5/474 |
| 3,823,428 | 7/1974 | Whyte | 5/429 |
| 3,851,345 | 12/1974 | Benoit et al. | 5/430 |
| 4,332,042 | 6/1982 | Koncelik | 5/60 |

FOREIGN PATENT DOCUMENTS

| | | | |
|---|---|---|---|
| 1943815 | 3/1970 | Fed. Rep. of Germany . | |
| 1766850 | 9/1971 | Fed. Rep. of Germany . | |
| 2336905 | 2/1975 | Fed. Rep. of Germany . | |
| 169437 | 11/1959 | Sweden . | |
| 614367 | 11/1979 | Switzerland | 5/425 |

*Primary Examiner*—Alexander Grosz

*Attorney, Agent, or Firm*—Cushman, Darby & Cushman

[57] ABSTRACT

A bed assembly is provided particularly for geriatric use. The bed includes a mattress supported by a frame having a plurality of supporting legs, and bolsters are provided on either side of the mattress, mounted so that a top surface of each is substantially even with the top of the mattress. An undercarriage support structure including a pair of horizontal channel members are provided for receiving the legs of the mattress supporting frame and preventing substantial movement thereof with respect to the bolsters. The horizontal channel members include a pair of end portions which are received by passageways associated with the bolsters and allow the bolsters to be slid up and down off of and onto the undercarriage. A rail is mounted on each bolster for movement from a position below the top of the mattress to a position above the top of the mattress wherein it performs a roll-off preventing function. Each rail is mounted at the head of the bolster with which it is associated and is telescopic along the length of the mattress from the head toward the foot of the mattress. Actuation of the rails from the roll-off preventing position to below the mattress top requires utilization of both hands of an operator and an initial movement opposite the desired direction of movement of the rails.

10 Claims, 10 Drawing Figures

GERIATRIC BED CONSTRUCTION WITH SIDEGUARDS

BACKGROUND AND SUMMARY OF THE INVENTION

The invention relates primarily to a bed assembly, and component parts thereof, specifically designed for use in long term care facilities for the aged, commonly and frequently referred to as nursing homes. The nursing home environment is completely different from a hospital environment and this uniqueness provides special design considerations for the furnishings utilized in such environments. A general disclosure and discussion of a system taking cognizance of the general design criteria is provided in copending patent application Ser. No. 136,095 filed Mar. 31, 1980 now U.S. Pat. No. 4,332,042 by Joseph A. Koncelik, now U.S. Pat. No. 4,332,042. The present invention relates to a particular bed assembly, and component parts, for use in such a geriatric system.

According to one aspect of the present invention, an assembly for use with a bed including a mattress and a mattress supporting frame having a plurality of legs for supporting a mattress off the ground, are provided. The assembly includes bolsters, such as shown in said copending application Ser. No. 136,095, now U.S. Pat. No. 4,332,042 elongated in parallel directions of elongation and mounted with respect to the mattress so that they are disposed along opposite sides of the mattress exteriorly of the mattress supporting frame. Such bolster mounting means includes an undercarriage support structure for receiving legs of the mattress supporting frame with which it may be utilized to prevent substantial movement of the legs with respect to the bolsters. The undercarriage support structure is simple in design and provides a structure that is capable of readily positioning the bolsters with respect to the mattress in an operative position, and allows for mounting of the bolsters so that they may be readily removed for cleaning, repair, etc. The undercarriage support structure may include a pair (or more) of horizontal channel-shaped members, which in turn may include vertically extending end portions and horizontally extending extensions generally perpendicular to the horizontal channel-shaped members. The vertical end structures receive cooperating structure on the bolsters for allowing ready removable mounting of the bolsters on the frame structure, and the horizontal extensions allow ready movement of the bed into place on the undercarriage support. The undercarriage support includes vertically adjustable floor glides which allow adjustment of the position of the bed to accommodate uneven floor surfaces.

Mounted at the head of the bed assembly, preferably directly to the bolsters, is a rail means that provides a roll-off preventing function in an upward position thereof, but is movable below the level of the top of the mattress out of the way. The rail means are constructed so that an operator must use both hands to move the rail means between the above mattress and below-mattress positions, and must actuate actuating means in a direction opposite the direction of movement of the rail means. This greatly reduces the probability that any unauthorized actuation of the rail means may be effected by a person in the bed having limited ambulatory capabilities.

The rail means also comprise telescopic first and second portions which allow adjustment of the length of the rail along the bed. The length may be shortened to allow ready access to the bed (not preventing ingress to the central portion of the bed and providing a handhold for facilitating ingress), yet provides a complete roll-off preventing function when extended.

In general, the structures comprising the bed assembly according to the present invention are ideally suited to nursing home environments, taking into account many of the needs, capabilities, and limitation of aged people, to facilitate maximum safety, comfort and control.

It is the primary object of the present invention to provide a bed assembly and component parts thereof especially adapted for use in the nursing home environment. This and other objects of the invention will become clear from an inspection of the detailed description of the invention, and from the appended claims.

DETAILED DESCRIPTION OF THE DRAWINGS

Figure 1:
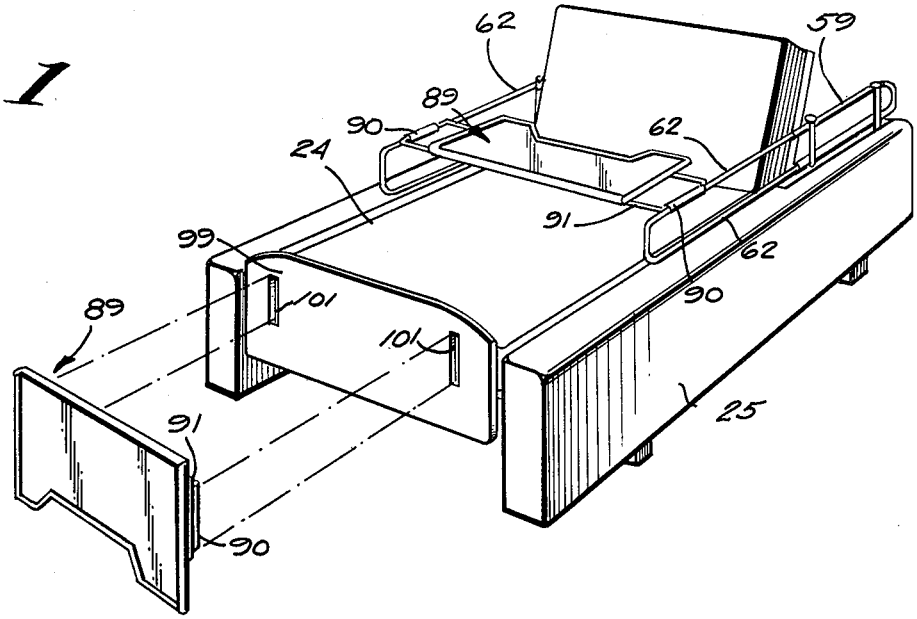
FIG. 1 is a perspective view of an exemplary bed assembly according to the present invention showing rails in extended, operative position and a bed mounted in place between a pair of bolsters and supported by an undercarriage structure.

The bed assembly illustrated in the drawings is designed to be utilized with other interior space division components, such as are illustrated in the aforementioned application Ser. No. 136,095 now U.S. Pat. No. 4,332,042 (the disclosure of which is hereby incorporated by reference herein). The bed assembly is illustrated generally at 10, and may be utilized with a headboard-wall panel 14. The headboard-wall panel 14, which may be connected up to other wall panels (including for support thereof in an upright position) is comparable to conventional upolstered panels for dividing work areas in office space, such as those sold by J. G. Furniture, a division of Burlington Industries, of Quakertown, Pa., under the names "UPS". Conventional panel joining hardware is utilized to attach panels together, and they may be connected together to provide at least a portion of the physical definition of the room environment in which the bed assembly 10 is to be utilized.

Preferably the panel 14 is spaced from the nursing home permanent walls and has a linear light source 23 (e.g., a fluorescent light) releasably mounted therein, as by hanging with hangers 33. The light source 23 shines light on at least areas of the bed assembly 10 adjacent the panel 14 across substantially the entire width thereof.

The bed assembly 10 includes a mattrees 24 and a pair of elongated bolsters 25, one disposed on either side of the mattress 24. The mattress 24 is supported by a conventinal mattress frame, having a plurality of legs for supporting the mattress off the ground, the bolsters 25 being independent thereof.

The height of the bed assembly 10 is substantially equal to the height of a seat of a wheelchair (e.g., 20 inches) and is designed and positioned so that no structural, bed rail devices, or accessory obstacles impede transfer to the bed assembly from a wheelchair or walker.

The bed assembly 10 provides the focal point for the room environment. A key feature thereof is the provision of the bolsters 25 alongside of the mattress 24. Each of the bolsters 25 is formed of material having sufficient hardness or rigidity so that a person may sit thereon without significantly deforming the same (see FIGS. 2 and 3), the bolsters 25 providing more support than an edge of mattress 24. This facilitates the transfer to and from the bed, and facilitates visiting by ambulatory individuals and care by doctors, nurses, etcetera, whom may utilize the bolsters 25 as seats. The length of each bolster 25 is substantially the same as the length of the mattress 24, with a width substantially less than the length or height but sufficient to facilitate bed egress and ingress.

While being hard enough to allow a person to sit thereon without significantly deforming the same, the bolsters also are soft enough so that a person falling so as to impact the side of the bed will impact a bolster and will have their fall cushioned by a bolster 25 so as to minimize the chances of injury. The bolsters 25 thus provide for covering of all bed hardware, and other sharp or hard components associated with the bed assembly. This is important since many injuries in nursing homes are caused by residents falling and impacting bed hardware.

Figure 2:
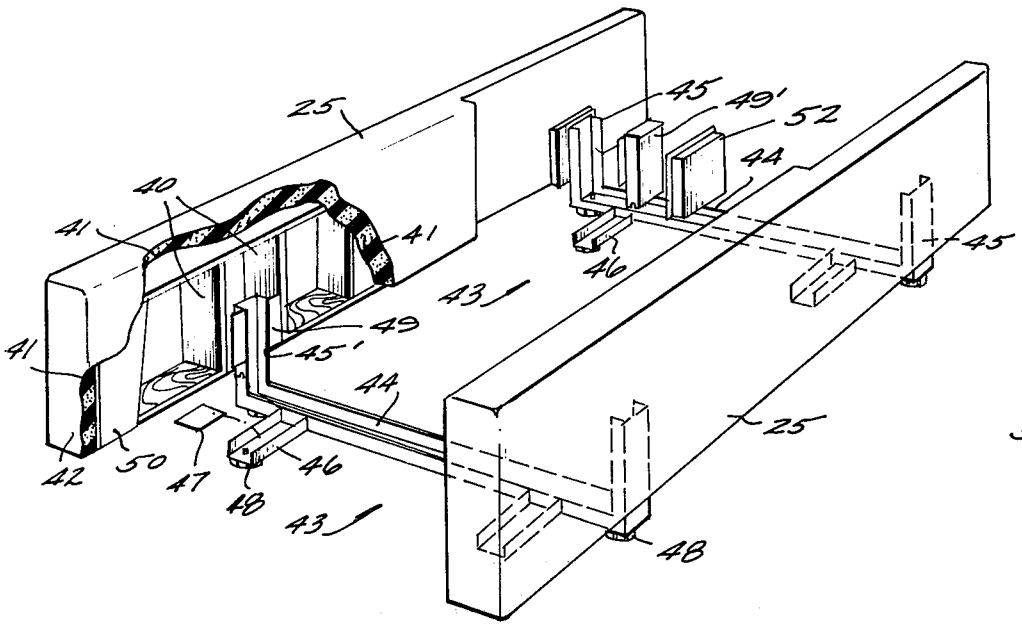
FIG. 2 is a perspective view, with portions cut away for clarity, of an exemplary set of bolsters and undercarriage structure according to the teachings of the present invention.
Figure 5:
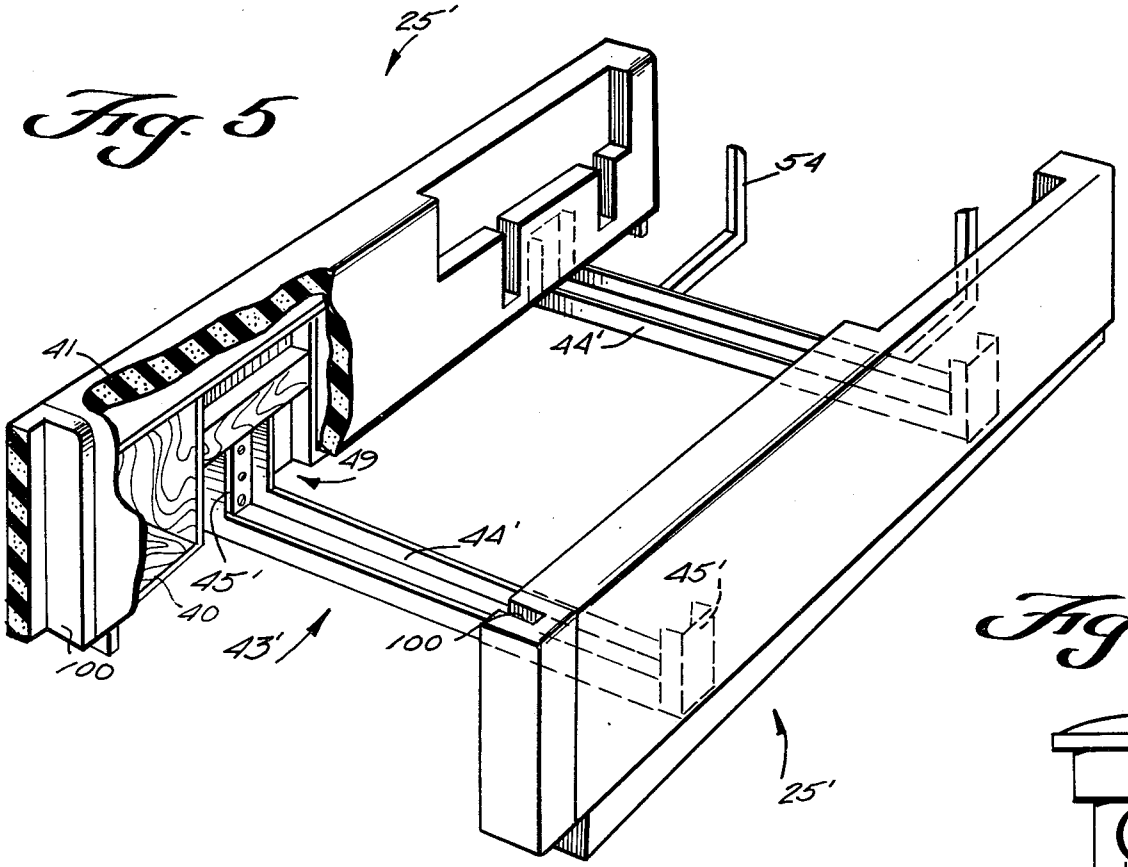
FIG. 5 is a perspective view, with portions cut away for clarity, of another exemplary form of bolsters and undercarriage support structures that may be utilized according to the present invention.

Exemplary interior constructions of bolsters 25, 25' are illustrated in FIGS. 2 and 5. The bolster 25 may comprise a frame 40 of relatively rigid material (e.g., wood) with a covering of relatively softer material, such as foam 41 covered with sheet material 42 (e.g. vinyl). An exemplary foam 41 that is suitable for providing the bolsters 25 with their desired characteristics is sold under the name RICHLUX T 111, manufactured by E. R. Carpenter Company, and having a minimum density of about 6 pounds per cubic foot, and a minimum resiliency of about 35%. Other generally comparable foams are of course also suitable.

Means are provided for mounting the bolsters with respect to the mattress 24 so that thc top surface of each may be substantially even (although the bed mattress 24 may be adjustable upwardly and downwardly; the top of the bolster 25 provides a reference height, however), and so that a person impacting the bed assembly along the sides thereof will impact a bolster 25. The bolster mounting means may comprise an undercarriage support structure, illustrated generally at 43, 43' in FIGS. 2 and 5, for receiving the legs of a conventional mattress supporting frame and preventing substantial movement thereof with respect to the bolsters 25. The undercarriage support structure may include a pair of horizontal channel-shaped metal members 44, 44' extending perpendicular to the direction of elongation of the bolsters 25, 25' respectively, and each having a pair of end portions, 45, 45' extending vertically. The vertical end portions 45, 45' also are preferably channel shaped. The members 44 are positioned relative to the bolsters 25 in positions convenient for proper support thereof, and where necessary or desirable open-ended channel-shaped extensions 46 from the members 44 are provided to actually receive the legs of the bed supporting frame. Conventional beds are readily moveable onto such extensions 46. A pad 47 may be provided in each structure 46 at a point at which the mattress frame leg will actually be touching the extension 46. The members 44, 46 also are provided with leveling leg portions 48, screw threaded into the members 44, 46 and adjustable to properly position the undercarriage 43 on uneven floor surfaces (see FIGS. 2 and 4 in particular).

Structures are associated with the bolsters 25 for receipt of the end portions 45 of members 44. While the bolsters 25 and end portions 45 may be rigidly attached, preferably the bolsters 25 merely slide over the vertical members 45 so that the bolsters may be readily removed for ease of cleaning, maintenance, and interchangeability of bed types. Adjacent the foot of the bed where the bolster is widest, an interior passageway may be provided in the bolster 25 that is shaped to receive a vertical portion 45 of undercarriage 43. Such a passageway may be provided by a channel component 49 corresponding in shape to the portion 45, and rigidly attached to the interior rigid frame panel 50 of bolster 25. Adjacent the head of the bed where the bolster 25 is narrower (in the FIG. 2 embodiment), in order to accommodate a rail assembly (to be further described) there may not be room for an interior passageway. Under such circumstances, an exterior channel component 49' may be provided which is rigidly attached to a board 51 mounted to the bolster 25, both board 51 and member 49' being covered by a cap 52 (see FIG. 2).

Figure 4:
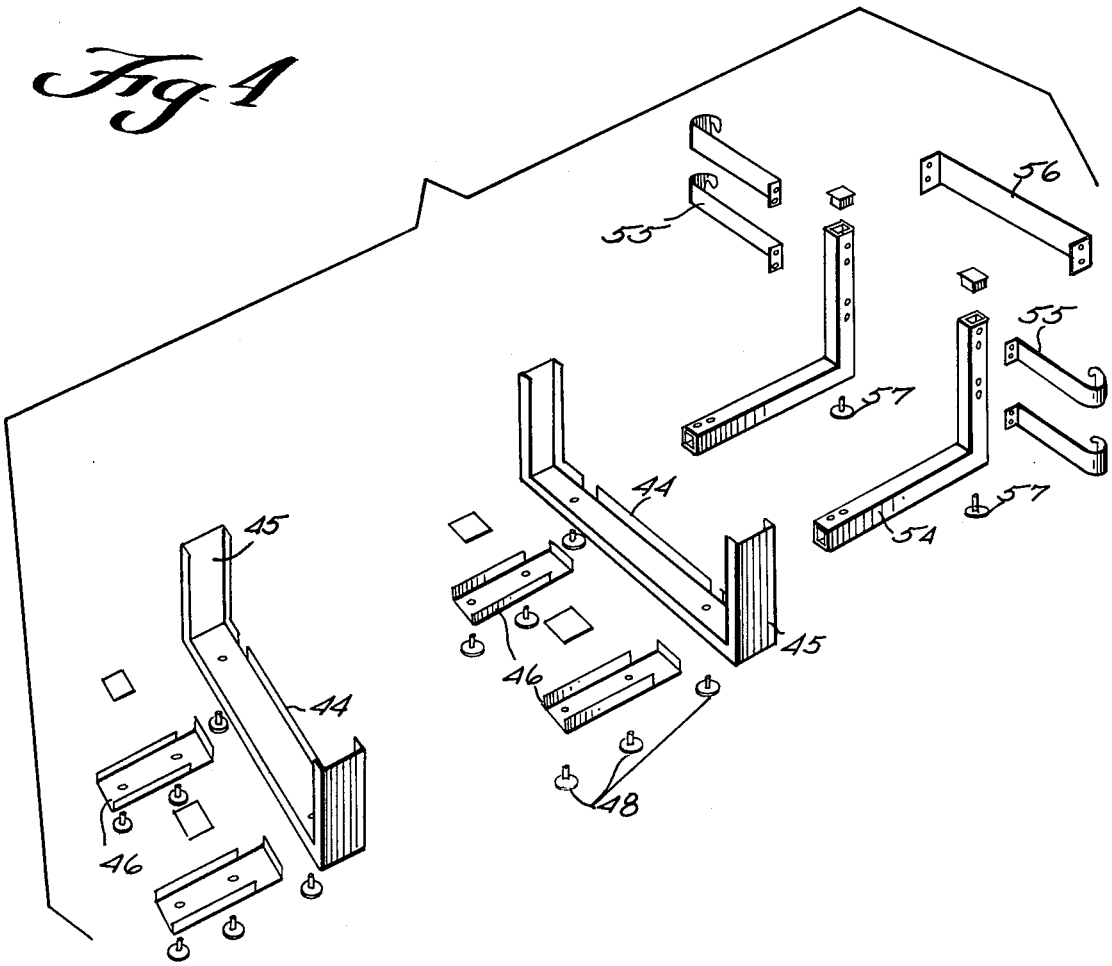
FIG. 4 is an exploded detail view of the undercarriage and headboard-wall panel structures illustrated in FIGS. 2 and 3.
Figure 3:
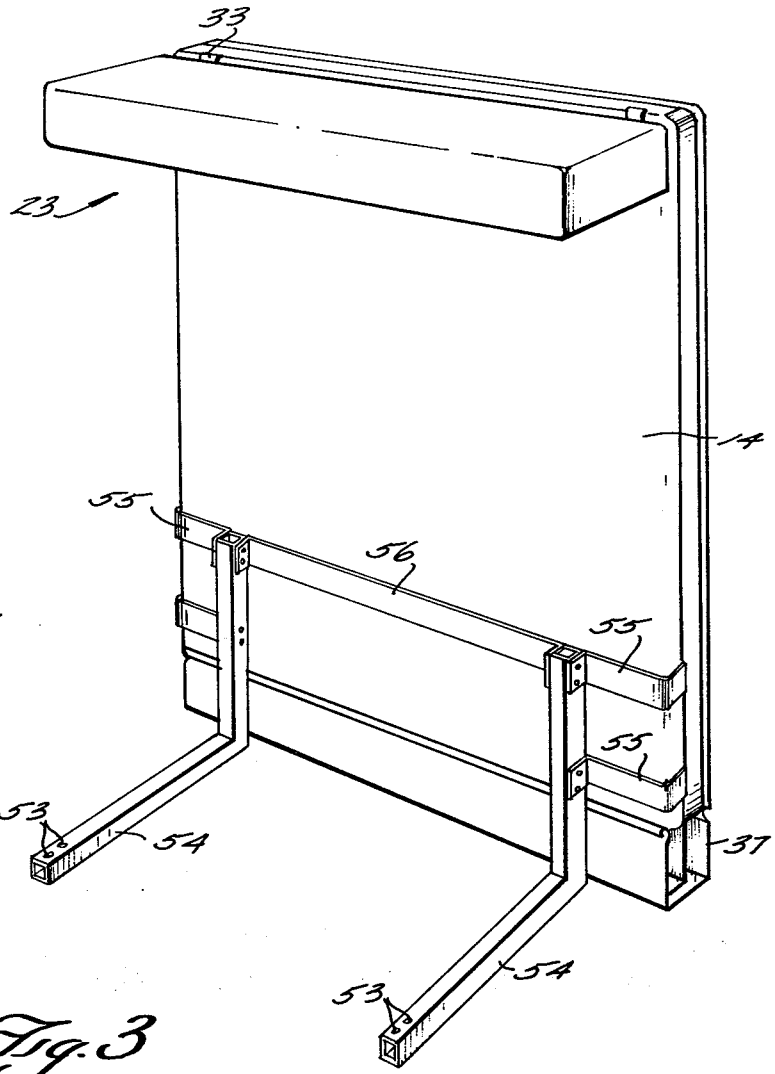
FIG. 3 is a perspective view of an exemplary headboard-wall panel that may be utilized with the structure of FIG. 2.

The mounting means for the bolsters (i.e., undercarriage 43, 43') are constructed with respect to the mattress 24 so that each of the bolsters is spaced from a side of the mattress 24 a distance corresponding to about the width of an individual's hand, so that the mattress 24 may readily be properly covered with sheets and/or blankets, etcetera, with the bolsters 25 in place, yet the bolsters are not substantially spaced from the mattress. Cleaning of the interior bolster surfaces also is easy. The bolsters 25, located as illustrated in the drawings, also prevent roll-out from the bed by providing a firm surface and tactile difference that signals to the user that the edge of the bed is being reached.

Where it is desirable to mount the headboard-wall panel to the bolster mounting means, hardware such as illustrated in FIGS. 3 and 4 may be provided. Such hardware includes right-angled supporting tubes 54 that may be received by cutout portions in the upstanding flange of undercarriage member 44 at the head of the bolsters 25, and/or can be attached thereto with screws or other fasteners passing through screw holes 53. The tubes 54 are connected to the headboard-wall panel 14 utilizing backets 55 which engage the panel edges much like the hangers 33, and strap 56 spaces the tubes 54 apart. Vertically adjustable floor glides 57, comparable to components 48, may be provided on the bottoms of tubes 54 if desired (see FIG. 4).

In many situations, however, the headboard-wall panel 14 need not be directly connected to the undercarriage 43, but rather may be mounted with respect to, but unconnected to, the mattress 24 and bolster mounting means by the other wall panels which are operatively attached thereto, including at least one wall panel extending in a plane substantially perpendicular to the plane of the panel 14.

Rail means are associated with the bolsters 25 for preventing one on mattress 24 from rolling off the mattress. However, unlike many conventional rail systems, the rail means are readily adjustable in length along the dimension of elongation of the bolsters 25 to provide a first position wherein bed ingress or egress is allowed while the rail means provides a support surface for assiting in the ingress or egress; and a second position wherein ingress and egress is substantially prevented and the roll-off function is maximized. Mounted at the head of the mattress 24, the rail means do not interfere with ingress or egress, yet may provide a hand support for the aged user.

The rail means also are movable to a completely inoperative position below the top of the bolsters 25. In the inoperative position the rail means are completely out of the way and provides no safety hazard or the like.

Figure 6:
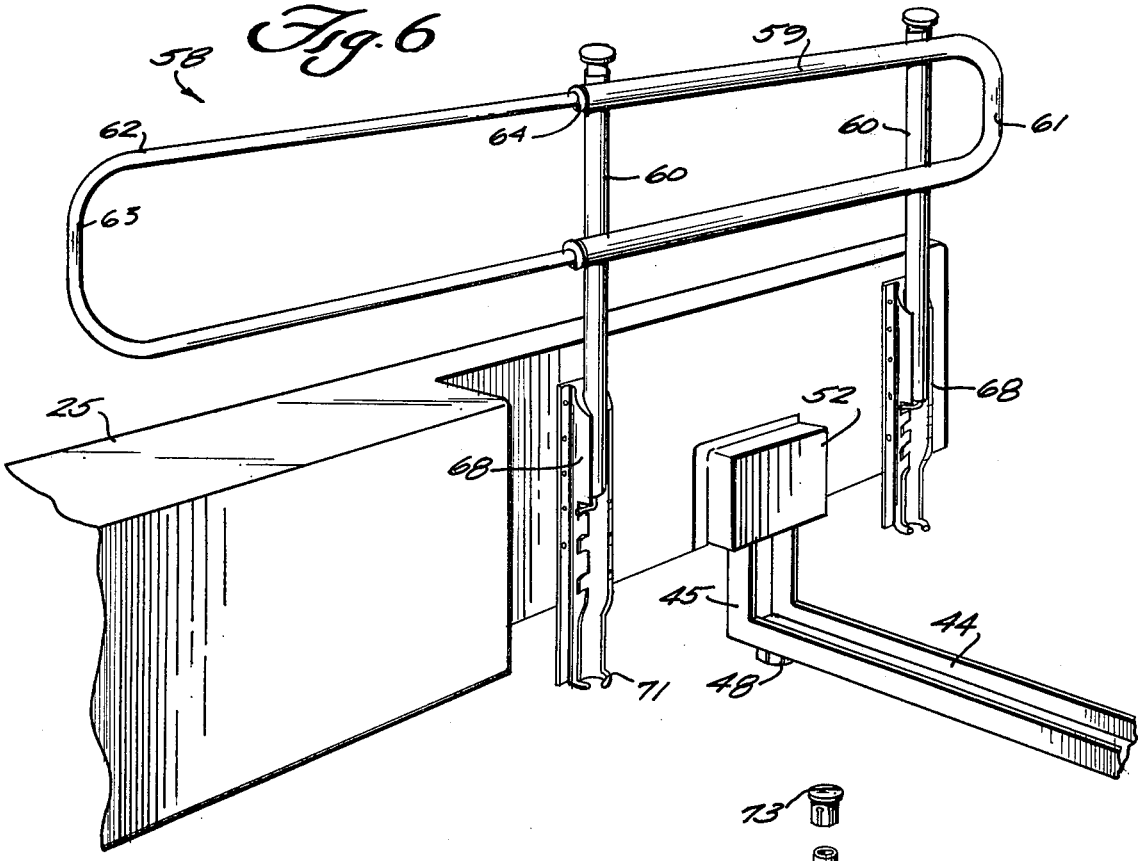
FIGS. 6 and 7 are perspective assembly and exploded views, respectively, of an exemplary rail assembly according to the present invention, utilizable with the bolsters illustrated in FIG. 2.
Figure 7:
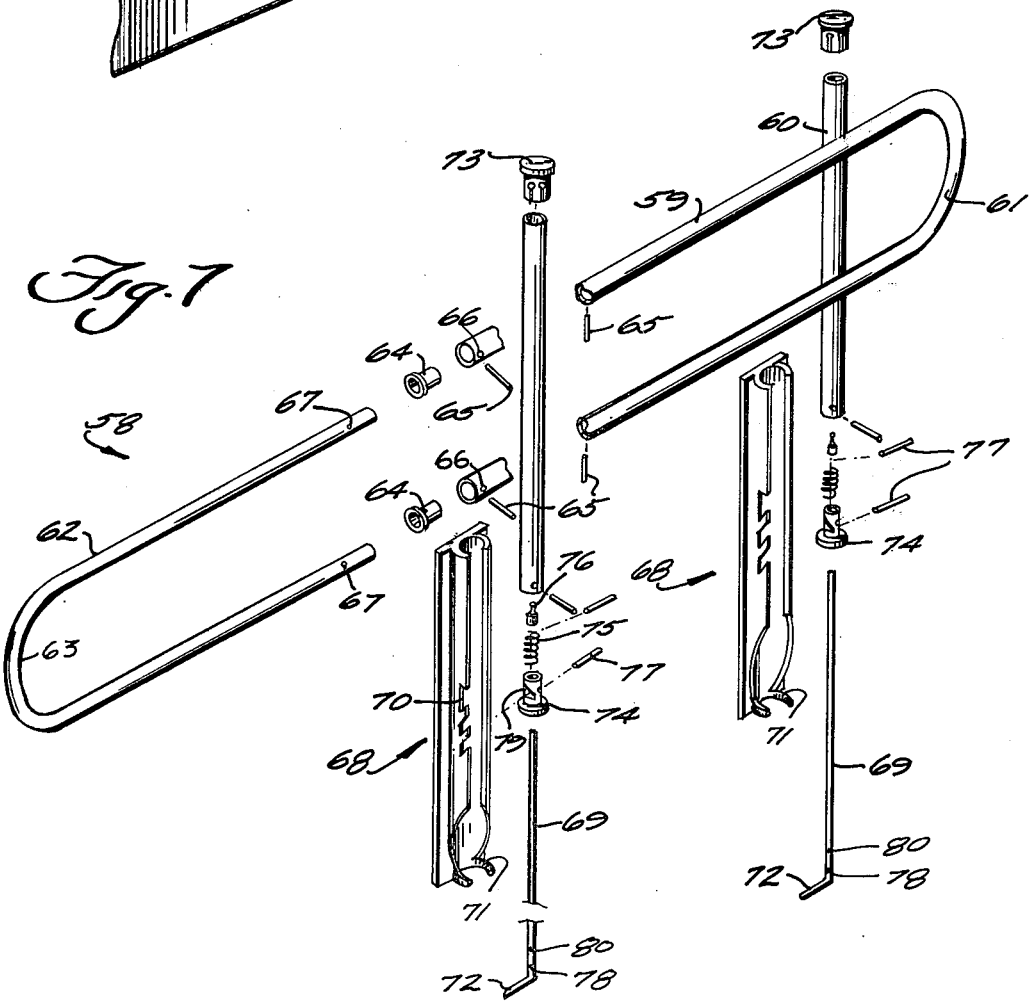

Exemplary rail means are indicated generally by reference numeral 58 in the drawings, and are illustrated most clearly in FIGS. 6 and 7. The rail means 58 include a first hollow tubular portion 59 rigidly attached to upstanding tubular supports 60. The tubular first portion 59 includes two vertically spaced portions, which preferably are interconnected by rounded connecting portion 61. A second portion 62 also is provided including a pair of vertically spaced portions interconnected by a rounded interconnecting portion 63. The second portion 62 has an outside diameter slightly less than the inside diameter of the tubular first portion 59 so as to be telescopically received thereby. In a first position, second portion 62 is essentially completely received within the first portion 59 while in a second position it extends outwardly therefrom along the dimension of elongation of the bolster 25 with which it is associated (see FIGS. 1 and 6).

In order to prevent the second portion 62 from being completely withdrawn from the first portion 49, a rail cap/stop 64 (see FIG. 7) is provided associated with each of the vertically spaced portions of member 59, and spring pins 65 are associated therewith and openings 66, 67 in members 59 and 62, respectively.

The vertical support tubes 60 are mounted to the bolster 25 in such a way that they are movable from a position supporting the rail member 59 above the top of the bolster 25 (FIG. 6), to a position below the top of the bolster 25. The structure so mounting the tubes 60 is designed so that an operator moving the rail from one position to the other must use both hands and preferably must use an initial motion opposite of the direction of movement. Such contrary motions ensure a double measure of safety since a person not familiar with the operation would not understand how to do either.

The means mounting the vertical tube 60 include a pair of channels 68 rigidly attached to the head portion of the bolster 25 (as by screws). The channels 68 encompass more than a 180° arcuate portion of the tubes 60 to contain them therewithin. The tubes 60 are held in a position to which they have been vertically moved with respect to the channel 68 by the locking rods 69, which are adapted to cooperate with locking slots 70 and bottom surface 71 of channel 68.

Each channel 68, while extending more than 180° around tube 60, extends substantially less than 360°, being open in the front to allow vertical movement of latching portion 72 of latching rod 69, and portions of rail member 59 below the top of bolster 25.

Figure 8:
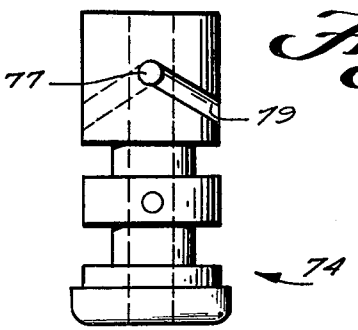
FIG. 8 is a side detail view of a swivel cap of the rail assembly of FIG. 7.
Figure 10:
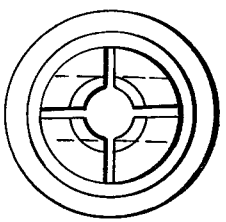
FIGS. 9 and 10 are side and bottom plan detail views, respectively, of a pushbutton cap of the rail assembly of FIG. 7.
Figure 9:
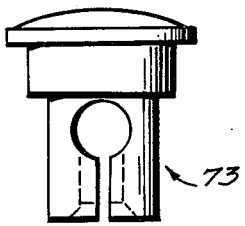

The latching portion 72 of each latching rod 69 is moved between positions received within slots 70 or by surface 71, and received by the open front of channel 68, utilizing push button cap 73, swivel cap 74, spring 75, latch rod assembly connector 76, and spring pins 77. Cap 73 is shown in detail in FIGS. 9 and 10, and cap 74 is shown in detail in FIG. 8. One spring pin 77 extends through an opening 78 in latch rod 69 and through angled slot 79 in swivel cap 74, while another spring pin 77 extends through opening 80 in latch rod 79, with the spring 75 surrounding rod 69 and disposed between the pins 77. The top of latch rod 69 is knurled and receives latch rod assembly connector 76 thereon, the rounded head of the connector 76 being received by the latch button 73. Button 73 is constructed so that bottom portions thereof cam outwardly as the rounded head of connector 76 is brought into contact therewith, and then resiliently spring back to position abutting and maintaining the bottom of the rounded head of connector 76.

The components 73, 76, 74, and 68 all may be made of Delrin, Nylon, or like material, while the members 59, 60 and 62 preferably are metal (e.g. steel tubes with a mirror chrome finish). The latching rod 69 also is metal.

To lift the rail, one must push down on cap 73, which causes pins 77 engaging slots 79 to rotate latch portion 72 of latch rod 69 out of interfering engagement with surface 71, allowing the entire rail assembly to be moved upwardly until the latch member 72 engages a latching slot 70. Once in an extended position, the rail is moved downwardly by first lifting up on the cap actuator 73, again causing rotation of the latch portion 72 of latch rod 69 out of engagement with slots 70 so that the rail assembly may be moved downwardly.

As illustrated in FIG. 1, various structures may be utilized with the rail assembly for increasing the versatility of the entire bed assembly 10. For instance, the rails may mount controls for the bed (which conventionally can be a hospital-type bed having the ability to articulate in various manners), or may support an over bed tray 89 so that an individual sitting upon the mattress 24 may write or eat conveniently. The tray 89 has mounting clips 90 associated therewith which are adpated to receive the rail second portions 62, as illustrated in FIG. 1. The clips 90 are preferably mounted on rods 91 that can telescope with respect to the structures mounted on the bottom of the tray to move from the extended position illustrated in the top of FIG. 1 to the retracted position illustrated at the bottom of FIG. 1. Rail segments 101 (having substantially the same diameter as the rail second portion 62) may be mounted directly to the toeboard 99 of the bed for receipt by the clips 90 to hold the tray in place on the toeboard when not in use. Alternatively, an extension 100 see FIG. 5) of each bolster 25 may be provided having a channel-shape to receive the tray 89 therein.

It will thus be seen that according to the present invention a bed assembly, and component parts thereof, have been provided that are emminently suitable for use in a nursing home environment. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and devices.

What is claimed is:

1. An assembly for use with a mattress having a frame for supporting it above the ground so that it is generally horizontal; said assembly comprising:

rail means for preventing one on the mattress from rolling off the mattress, said rail means comprising a rail structure extending along at least one side of the mattress, and said rail structure including a first portion extending a first distance along the length of the mattress; a second portion; means for mounting said second portion on said first portion so that said second portion may be moved relative to said first portion from a first position wherein said first and second portions are substantially coextensive along the length of the mattress, to a second position wherein said second portion extends outwardly from said first portion a second distance along the length of said mattress, said second distance being less than the length of said mattress; and means for mounting said first portion at the head of the mattress so that said second portion moves from the head of the mattress towards the foot of the mattress, said second portion being solely supported by said first portion irrespective of the position of said second portion with respect to said mattress;

means for mounting said rail means first portion for vertical movement with respect to the mattress so that it can move from a position above the mattress, performing its roll-off preventing function, to a position below the top of the mattress wherin it does not restrict entry to and exit from the mattress; and said rail mounting means comprising a pair of vertically extending supports stationarily mounted with respect to said frame; a pair of vertically elongated rods, one received by each of said supports; cooperating locking means formed on said rods and said supports for providing interlocking of a said rod with a said support in at least one position wherein said rail means first portion extends above said mattress; and actuator means for effecting relative movement between said rods and said supports so that said rods do not interlock with said supports so that said rods may be vertically moved with respect to said supports.

2. An assembly as recited in claim 1 wherein said means for mounting said second portion on said first portion comprises two hollow rails, and wherein said second portion comprises two rail portions vertically spaced at one end thereof for receipt by said hollow rails of said first portion, and interconnected at the other end thereof, and wherein said first and second distances combined are less than the full length of the mattress.

3. An assembly as recited in claim 1 wherein said actuator means comprises a pair of separate actuator structures located apart a distance to prevent effective actuation of both with one hand of an operator; and including means for automatically biasing said actuator structure to a non-operative position, so that an operator must actuate one actuator structure with each hand to effect appropriate movement thereof the entire extent of the movement.

4. An assembly as recited in claim 3 wherein said actuator means comprises means for mounting said actuator structures so that the movement of the actuator structures into an operative position allowing movement of the rail means is in a direction opposite to the direction of movement of the rail means.

5. An assembly as recited in claim 1 wherein said elongated rods each comprise a tubular member with a latch rod extending through the interior thereof and received by a swivel cap, and wherein said actuator means include at least one angled slot formed in said swivel cap and cooperating with at least one pin stationary with respect to said tubular member, so that reciprocation of said latch rod is transformed by said pin and angled slot connection into rotation of said latch rod.

6. An assembly as recited in claim 1 further comprising at least one bolster elongated in a direction parallel to the same side of the mattress as said rail means, and further comprising means for mounting said rail means first portion to said bolster at the head of the mattress.

7. A bed assembly comprising: a mattress; a pair of bolsters elongated in parallel directions of elongation, one disposed on either side of said mattress, each bolster being formed of material of sufficient hardness so that a person may sit thereon without significantly deforming the same, each bolster providing more support than a mattress edge, yet each bolster being soft enough so that a person falling so as to impact a side of the bed will impact a bolster and will have their fall cushioned by the bolster so as to minimize the chances of injury; means for mounting said bolsters with respect to said mattress so that a top surface of each of said bolsters may be substantially even with the top of said mattress and so that a person impacting the bed assembly along the side will impact a bolster; rail means associated with each of said bolsters for extending above said bolsters and extending parallel to the direction of elongation of said bolsters for preventing one on said mattress from rolling off said mattress; said rail means comprising a first portion associated with each bolster and extending a first distance along the length of said bolster; a second portion; means for mounting said second portion on said first portion so that said second portion may be moved relative to said first portion from a first position wherein said first and second portions arc substantially coextensive along the length of each said bolster, to a second position wherein said second portion extends outwardly from said first portion a second distance along the length of each bolster, said distance being less than the length of said bolster; means for mounting each said first portion to a said bolster at the head of said mattress so that said second portion moves toward the foot of said mattress, said second portion being solely supported by said first portion irrespective of the position of said second portion with respect to said bolster;

means for mounting said rail means first portion for vertical movement with respect to the mattress so that it can move from a position above the mattress, performing its roll-off preventing function, to a position below the top of the mattress wherein it does not restrict entry to and exit from the mattress; and said rail mounting means comprising a pair of vertically extending supports stationarily mounted with respect to said frame; a pair of vertically elongated rods, one received by each of said supports; cooperating locking means formed on said rods and said supports for providing interlocking of said rod with a said support in at least one position wherein said rail means first portion extends above said mattress; and actuator means for effecting relative movement between said rods and said supports so that said rods do not interlock with said supports so that said rods may be vertically moved with respect to said supports.

8. A bed assembly as recited in claim 7 wherein said actuator means comprises a pair of separate actuator structures located apart a distance to prevent effective actuation of both with one hand of an operator; and including means for automatically biasing said actuator structure to a non-operative position, so that an operator must actuate one actuator structure with each hand to effect appropriate movement thereof the entire extent of the movement.

9. A bed assembly as recited in claim 8 wherein said actuator means comprises means for mounting said actuator structures so that the movement of the actuator structures into an operative position allowing movement of the rail means is in a direction opposite to the direction of movement of the rail means.

10. A bed assembly as recited in claims 7 or 9 wherein the mattress includes a frame having legs for supporting it, and wherein said bolster mounting means comprises an undercarriage support structure for receiving said legs of said mattress supporting frame and preventing substantial movement thereof with respect to said bolsters; and wherein said bolsters, with said rail means mounted thereon, may be readily removed from said undercarriage support structure.

* * * * *